US009661429B2

(12) United States Patent
Jacobs

(10) Patent No.: US 9,661,429 B2
(45) **Date of Patent: *May 23, 2017**

(54) SYSTEM AND METHOD FOR MODULAR ON-DEMAND AUDIO PROCESSING, AMPLIFICATION AND DISTRIBUTION

(71) Applicant: ZENOVIA ELECTRONICS INC., St. Albert (CA)

(72) Inventor: Logan Daniel Jacobs, St. Albert (CA)

(73) Assignee: Zenovia Electronics Inc., Acheson, AB (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,738

(22) Filed: Dec. 7, 2015

(65) Prior Publication Data

US 2016/0088411 A1 Mar. 24, 2016

Related U.S. Application Data

(63) Continuation of application No. 14/130,819, filed as application No. PCT/CA2012/000681 on Jul. 18, 2012, now Pat. No. 9,210,523.

(60) Provisional application No. 61/509,444, filed on Jul. 19, 2011, provisional application No. 61/532,800, filed on Sep. 9, 2011.

(51) Int. Cl.

| | |
|---|---|
| ***H04R 27/00*** | (2006.01) |
| ***H04R 1/02*** | (2006.01) |
| ***H04R 5/04*** | (2006.01) |
| ***H04S 7/00*** | (2006.01) |

(52) U.S. Cl.

CPC ..... *H04R 27/00* (2013.01); *H04R 5/04* (2013.01); *H04S 7/303* (2013.01); *H04R 2227/003* (2013.01); *H04R 2227/005* (2013.01); *H04R 2420/07* (2013.01); *H04R 2430/01* (2013.01); *H04R 2460/03* (2013.01)

(58) Field of Classification Search

CPC ..... H04R 27/00; H04R 1/02
USPC ..... 381/84, 87
See application file for complete search history.

(56) References Cited

U.S. PATENT DOCUMENTS 8,428,273 B2 * 4/2013 Nathan ..... H04R 5/04 340/311.2

* cited by examiner

*Primary Examiner* — Thjuan K Addy
(74) *Attorney, Agent, or Firm* — Tai W. Nahm; Miller Thomson LLP

(57) ABSTRACT

A system and method for processing, amplification and distribution of audio signals. In an embodiment, the method includes receiving at least one digital audio input signal from one or more audio sources via wireless or wired communications. In an embodiment, address information accompanying the at least one digital audio input signal is identified to determine to which modular processor/amplifier unit the audio signal is to be directed. In dependence upon identification of one or more modular processor/amplifier units, the identified one or more modular processor/amplifier units are awakened, and the processed/amplified audio signals is directed to one or more audio listening zones.

20 Claims, 14 Drawing Sheets

200

SYSTEM AND METHOD FOR MODULAR ON-DEMAND AUDIO PROCESSING, AMPLIFICATION AND DISTRIBUTION

CROSS-REFERENCE TO RELATED APPLICATIONS

The present application claims the benefit of U.S. Provisional Application No. 61/509,444 filed on Jul. 19, 2011, and U.S. Provisional Application No. 61/532,800 filed on Sep. 9, 2011, both of which are incorporated herein by reference in their entirety.

FIELD

The present disclosure relates generally to an audio processing, amplification and distribution system and method.

BACKGROUND

Over the years, various audio distribution systems have been developed for use in homes and buildings to broadcast audio over multiple listening zones, such as rooms or other living spaces. As an illustrative example, U.S. Pat. No. 5,255,322 issued to Farinelli et al., discloses a multi-zone audio distribution amplifier system having a housing to store modular, cascadable amplifier units. Each amplifier unit includes an input port for receiving an input stereo signal, at least one amplifier circuit to amplify the input signal, and an output port for providing access to the amplified stereo signal. Speakers in various rooms receive the amplified signal from their respective amplifier in the housing. With the Farinelli et al. system, each amplifier is dedicated to amplifying an audio input signal for playback in a listening zone via dedicated speakers.

While the Farinelli et al. system may be suitable for applications where an audio signal is generally distributed to all zones at the same time, or particular audio inputs are generally directed to particular audio outputs, this prior art audio distribution system may be less than optimal when considerable flexibility is required for directing a number of audio sources to different zones.

What is needed is an improved audio distribution system with greater configuration flexibility which may overcome some of the limitations of the prior art.

SUMMARY

The present disclosure is related to a system and method for modular on-demand audio processing, amplification and distribution which may be configured to receive and process wireless or wired audio input signals from one or more audio sources; amplify on-demand the one or more processed audio input signals using one or more amplifiers; and distribute the processed and optionally amplified audio signals for playback via one or more speakers in one or more listening zones.

In an embodiment, the system includes an audio processing and amplification panel or housing which may accept one or more modular audio processing and amplification units. The one or more modular audio processing and amplification units may be configured to be normally on standby in the absence of an audio input signal, and to process and optionally amplify any audio input signals on-demand upon receipt of an audio signal or wake signal directed or addressed to the one or more modular audio processing and amplification units. The processed audio signals are then distributed to one or more speakers in one or more listening zones in various ways.

In another embodiment, the one or more speakers in the one or more listening zones are self-powered speakers which are connected wirelessly to the audio processing and amplification panel, such that there is no need to connect the speakers to the amplifier speaker connections using speaker wire. Rather, in this embodiment, the system pairs each wireless speaker to a digital line output which bypasses the amplification stage of the one or more audio processing and amplification units. Line outputs from one or more audio processing and amplification units are connected to a wireless audio signal transmitter, and received by one or more of the self-powered, wirelessly connected speakers.

In another embodiment, the one or more speakers in the one or more listening zones are connected conventionally to the audio processing and amplification panel or housing using speaker wire. The audio processing and amplification panel or housing may accept one or more interchangeable modular audio processing and amplification units to activate and enable audio playback on the one or more speakers in the one or more listening zones.

In another embodiment, the one or more interchangeable modular audio processing and amplifications units may be configured to be normally on standby in the absence of a wake signal or wireless audio input signal, and to process and optionally amplify any wireless audio input signals on-demand upon receipt of a wake signal or wireless audio signal directed or addressed to the one or more modular audio processing and amplification units. The processed audio signals are then distributed to one or more speakers in one or more listening zones.

In this respect, before explaining at least one embodiment of the system and method of the present disclosure in detail, it is to be understood that the present system and method is not limited in its application to the details of construction and to the arrangements of the components set forth in the following description or illustrated in the drawings. The present system and method is capable of other embodiments and of being practiced and carried out in various ways. Also, it is to be understood that the phraseology and terminology employed herein are for the purpose of description and should not be regarded as limiting.

DETAILED DESCRIPTION

Figure 1:
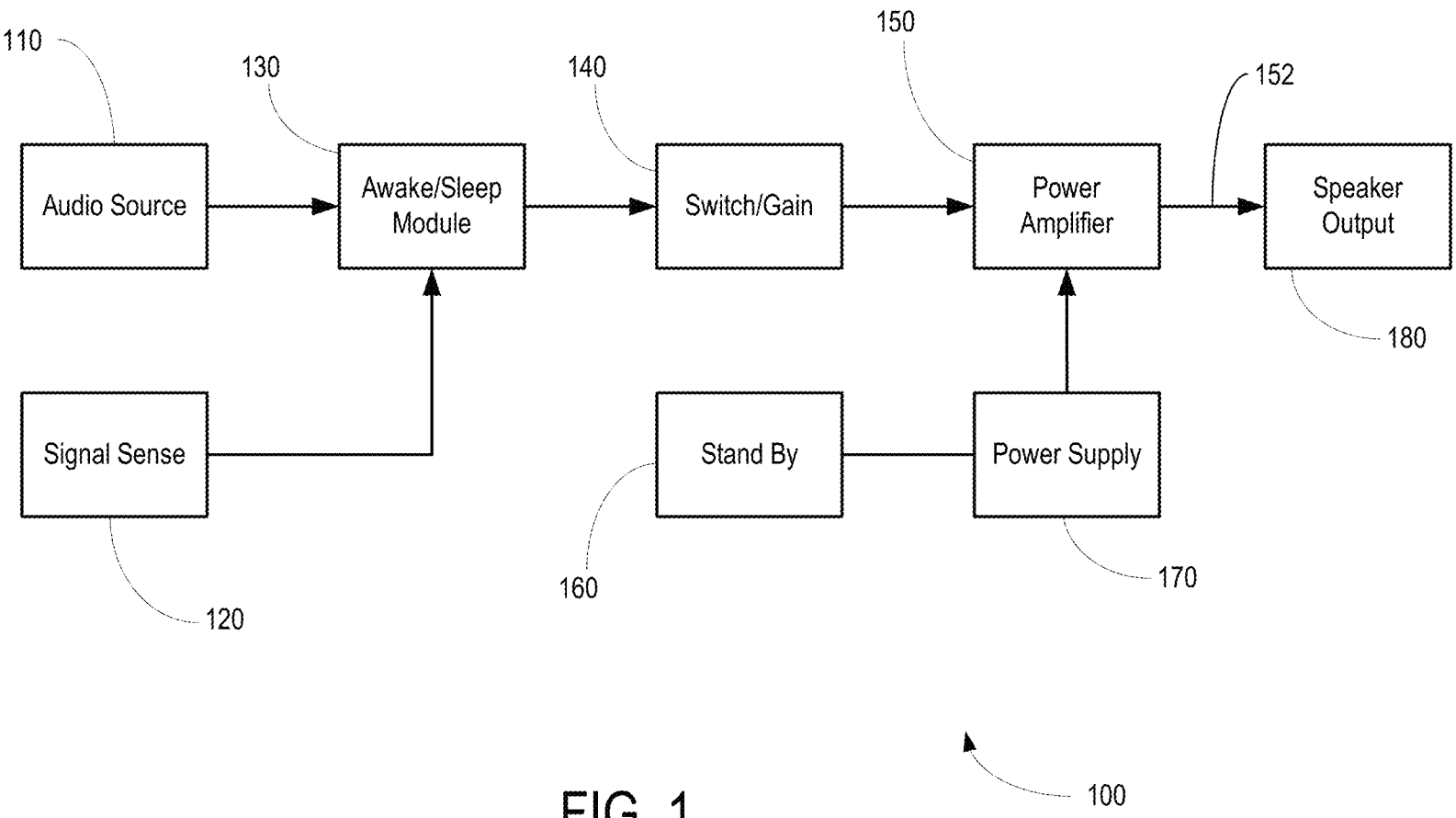
FIG. 1 shows a schematic block diagram of an audio processing, amplification and distribution system in accordance with an embodiment.

As noted above, the present disclosure is related to a system and method for modular on-demand audio processing, amplification and distribution which may be configured to receive and process wireless or wired audio input signals from one or more audio sources; amplify on-demand the one or more processed audio input signals using one or more amplifiers; and distribute the processed and optionally amplified audio signals for playback via one or more speakers in one or more listening zones.

In an embodiment, the system and method may operate in a network environment, such as within a Wi-Fi computer network hot spot set up in a home or a building.

In another embodiment, the system includes an audio processing and amplifier panel or housing which may accept one or more modular amplification units. The one or more modular amplifier units may be configured to be normally on standby in the absence of an audio input signal, and to amplify any audio input signals on-demand upon receipt of an audio signal or wake signal directed or addressed to the one or more modular amplifier units. The amplified audio signals are then distributed to one or more speakers in one or more listening zones via a suitable audio out multi-switch. In an embodiment, the audio out multi-switch may be configured to be controllable by logic to allow any one of the modular amplifier units to direct its amplified audio signal to any one of the listening zones via the one or more speakers.

In another embodiment, the system includes an audio processing and amplification panel or housing which may accept one or more modular audio processing and amplification units. The one or more modular audio processing and amplification units may be configured to be normally on standby in the absence of an audio input signal, and to process and optionally amplify any audio input signals on-demand upon receipt of an audio signal or wake signal directed or addressed to the one or more modular audio processing and amplification units. The processed audio signals are then distributed to one or more speakers in one or more listening zones in various ways.

In one embodiment, the one or more speakers in the one or more listening zones are connected conventionally using speaker wire. In this embodiment, the processed audio signals are also amplified for output to the one or more speakers connected using speaker wire.

In another embodiment, the one or more speakers in the one or more listening zones are self-powered speakers which are connected wirelessly to the audio processing and amplification panel, such that there is no need to connect the speakers to the amplifier speaker connections using speaker wire. Rather, in this embodiment, the system pairs each wireless speaker to a digital line output which bypasses the amplification stage of the one or more audio processing and amplification units. Line outputs from one or more audio processing and amplification units are connected to a wireless audio signal transmitter, and received by one or more of the self-powered, wirelessly connected speakers.

In another embodiment, the one or more speakers are connected to the audio processing and amplifier panel via a power line, such that a digital audio signal is transmitted over the power line from the audio processing and amplifier panel to a speaker with a digital audio signal receiver which receives the digital audio signal and converts it to an analog audio signal for amplification and playback via the power line connected speaker. In this embodiment, the audio signal once again bypasses the amplification stage of the audio processing and amplifier module.

In another embodiment, the one or more speakers are connected to the audio processing and amplifier panel via more than one connecting means. For example, left and right channel speakers may be connected by speaker wires or by a wireless connection, and a subwoofer connected via a power line. Any combination of connections is possible.

In another embodiment, the audio processing and amplification panel further includes a wireless transceiver, such as Wi-Fi, allowing connection of the audio processing and amplification panel to the Internet. With this embodiment, the audio processing and amplification panel may be configured as an Internet radio for receiving any one of numerous Internet radio transmissions. In an embodiment, the audio processing and amplification panel may be configured to direct more than one Internet radio transmission simultaneously through different audio processing and amplification panels, such that speakers in different audio listening zones may be outputting sound from different Internet audio stations.

The system and method of the present disclosure allows audio signals to be amplified and distributed to multiple listening zones with greater flexibility than was possible with earlier designs. By providing a modular, scalable design for adding modular amplifier units, the system can also be suitably sized and configured for the number of listening zones that the system needs to support. The modular amplifier units can also be removed if there is excess or redundant capacity to be used in another compatible audio distribution system.

By providing significant flexibility in building different configurations, it is believed that the present modular audio distribution system may help to stimulate the development of compatible audio processing and amplifier modules that can be installed in a modular fashion and implemented on a wide scale in commercial and residential audio amplification and distribution applications.

The system and method will now be described in more detail with reference to the drawings. It will be understood, however, that the drawings and the accompanying description illustrate just one possible embodiment, and different embodiments are possible.

Now referring to FIG. 1, shown is a schematic block diagram of an amplification system in accordance with an embodiment. As shown, FIG. 1 illustrates an audio source 110 which may provide a wired or wireless audio input signal. As an illustrative example, the audio source 110 may be an existing wireless digital audio transmission technology, such as AirPlay™ offered by Apple™.

The audio input signal is received by an awake/sleep module 130 which may receive an input from a signal sensing module 120 that an audio input signal is present. Signal sensing module 120 may be a separate module, or integrated within another module as desired. Awake/sleep module 130 may be configured to switch from a sleep mode to an awake mode in the presence of an audio input signal to switch on power amplifier 150 and increase the gain 140 of the audio input signal for amplification by power amplifier 150. Power amplifier 150 draws power from a power supply 170 which may remain in a standby state 160 until power is required by the power amplifier 150 to amplify the audio input signal. As shown, the amplified audio signal is output via conductive speaker wires 152 to positive and negative terminals of a pair of speaker outputs 180 to drive them. Gain 140 may be adjusted to control the volume of the speakers in a given audio listening zone.

Figure 2A:
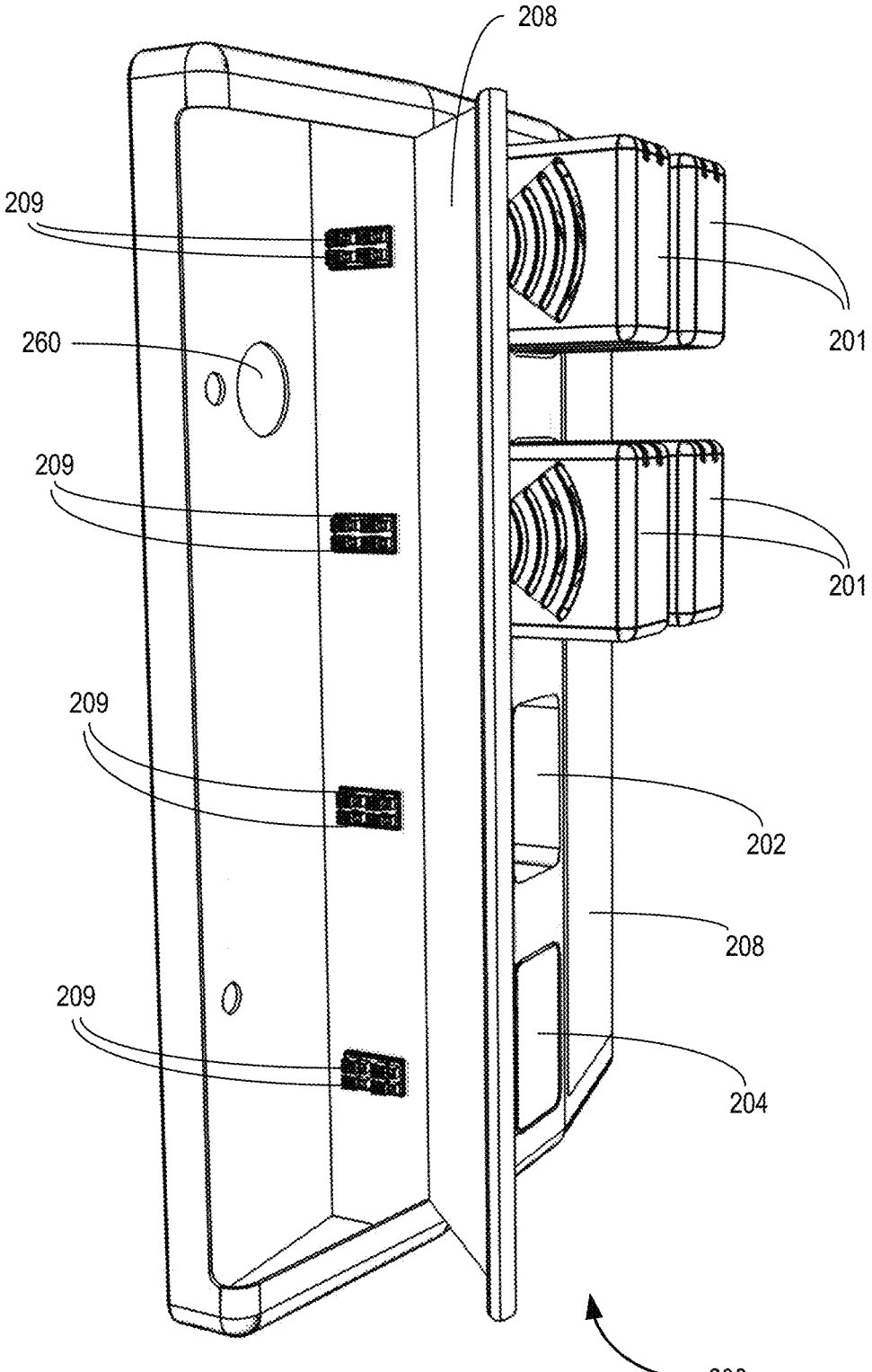
FIGS. 2A-2C show illustrative views of a panel housing for a modular audio processing, amplification and distribution system in accordance with an embodiment.
Figure 2B:
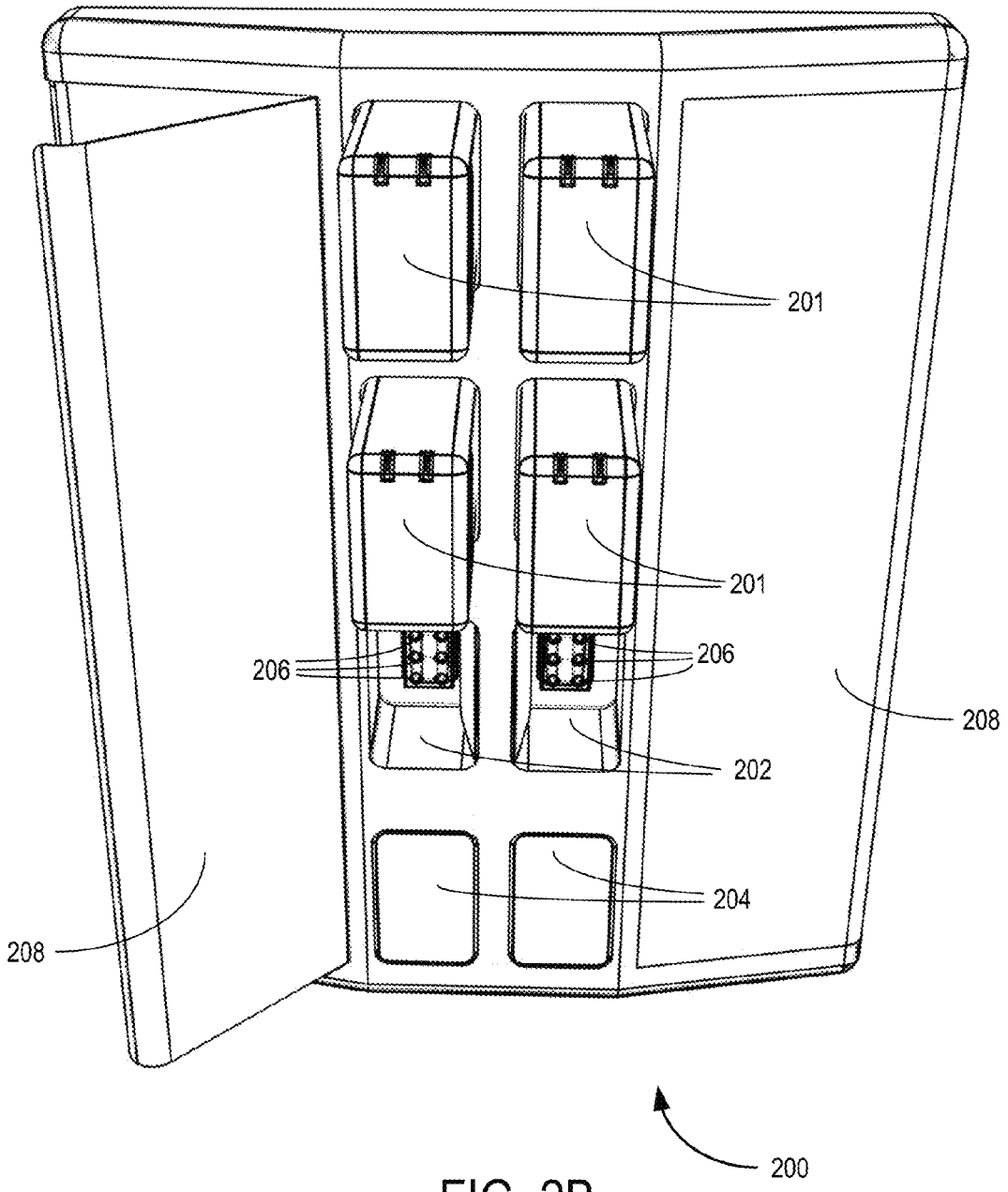
Figure 2C:
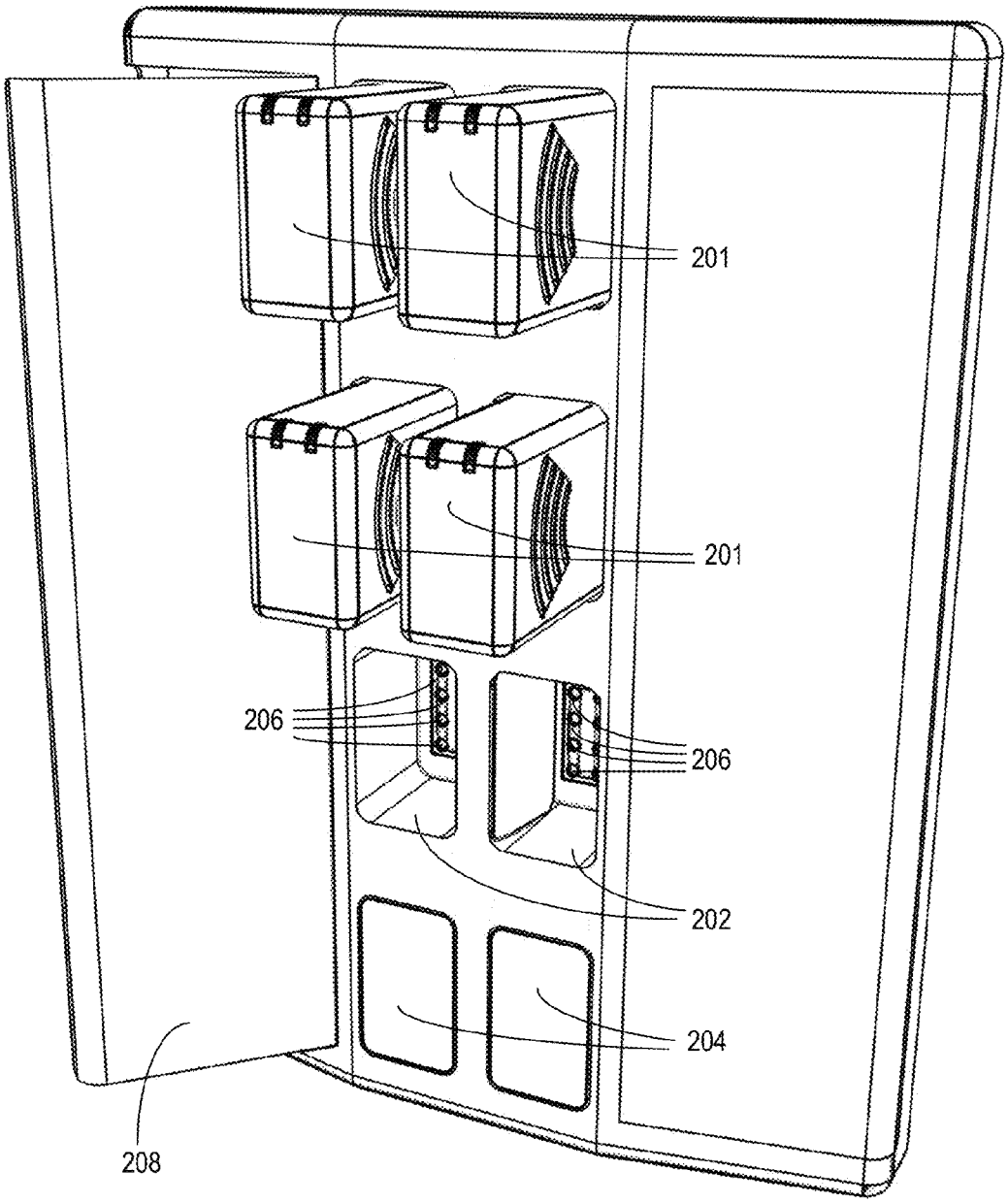

Now referring to FIGS. 2A-2C, shown is an illustrative diagram of a panel housing for a processing, amplification and distribution system in accordance with an embodiment. As shown, the panel housing embodies a modular audio processing, amplification and distribution system 200, which may include one or more modular processor/amplifier units 201. As shown, a plurality of modular processor/amplifier units 201 may be installed in the panel. For example, the modular processor/amplifier units 201 may be inserted into slots 202 which may optionally be covered by covers 204. When fully inserted within slots 202, the modular processor/amplifier units 201 may be connected to the panel via a plurality of connectors 206.

In a preferred embodiment, the modular processor/amplifier units 201 are of a standard size, with standard connection points to the plurality of connectors 206. Not all connectors 206 need to have an active connection to the modular processor/amplifier units 201 if not required.

In an embodiment, the panel housing may further include hinged doors 208 providing access to a plurality of speaker connection points 209 for a plurality of speakers. In an embodiment, these plurality of speaker connection points 209 may comprise standard speaker wire connections for connecting the negative and positive terminals of speaker wires.

In another embodiment, the modular audio processing, amplification and distribution system 200 may be connected to a plurality of speakers via conductive wires 152 connected to speakers (not shown) via a wiring conduit. The wiring conduit may connect speakers in multiple audio listening zones through wall spaces and ceiling spaces to connect all speakers to the modular audio processing, amplification and distribution system 200.

In an illustrative embodiment, the modular audio processing, amplification and distribution system 200 may be configured in a manner somewhat similar to an electrical panel distribution system in a typical house hold, except that the system accepts modular amplifier units that amplify and distribute an audio signal throughout a home or a building to audio speakers. In an embodiment, the electrical wiring in a house or building may be used to connect the audio processing, amplification and distribution system 200 to self-amplified speakers connected via various electrical outlets. This will be described in more detail further below.

FIGS. 3A-3D show illustrative views of a panel housing for a modular audio processing, amplification and distribution system in accordance with another embodiment. As shown, the panel housing embodies a modular audio processing, amplification and distribution system 300 which may include one or more modular processor/amplifier units 301. A plurality of modular processor/amplifier units 301 may be installed in the panel. When fully inserted within slots, the modular processor/amplifier units 301 may be connected to the panel via a plurality of connectors 306.

In a preferred embodiment, the modular processor/amplifier units 301 are of a standard size, such that they are interchangeable within the slots. The modular processor/amplifier units 301 include connection points configured to connect to the plurality of connectors 306. In an illustrative embodiment, connectors 306 comprise a plug-in connector such that the modular processor/amplifier units 301 may be connected to the processing, amplification and distribution system 300 by fully inserting the modular processor/amplifier units 301 into a slot.

In one embodiment, the plug-in connector may be adapted from a standard connector which is modified to allow the pins to carry signals between the modular processor/amplifier units 301 and the processing, amplification and distribution system 300. By way of example, and not by way limitation, the plug-in connector may be physically adapted from a multi-pin and socket connector such as a standard DB-9 pin and socket connector. Various other types of standard connectors, such as DB-15 or DB-25, may be modified such that the pins carry various signals between the modular processor/amplifier units 301 and the processing, amplification and distribution system 300.

Advantageously, by utilizing a standard pin and socket connector type, and adapting the wiring as necessary for the present application, the connection of the modular processor/amplifier units 301 to the processing, amplification and distribution system 300 is simplified, and the costs for producing the connectors 306 can be minimized. Furthermore, the standard connectors 206 allow the modular processor/amplifier units 301 to be readily interchanged between slots.

Figure 3A:
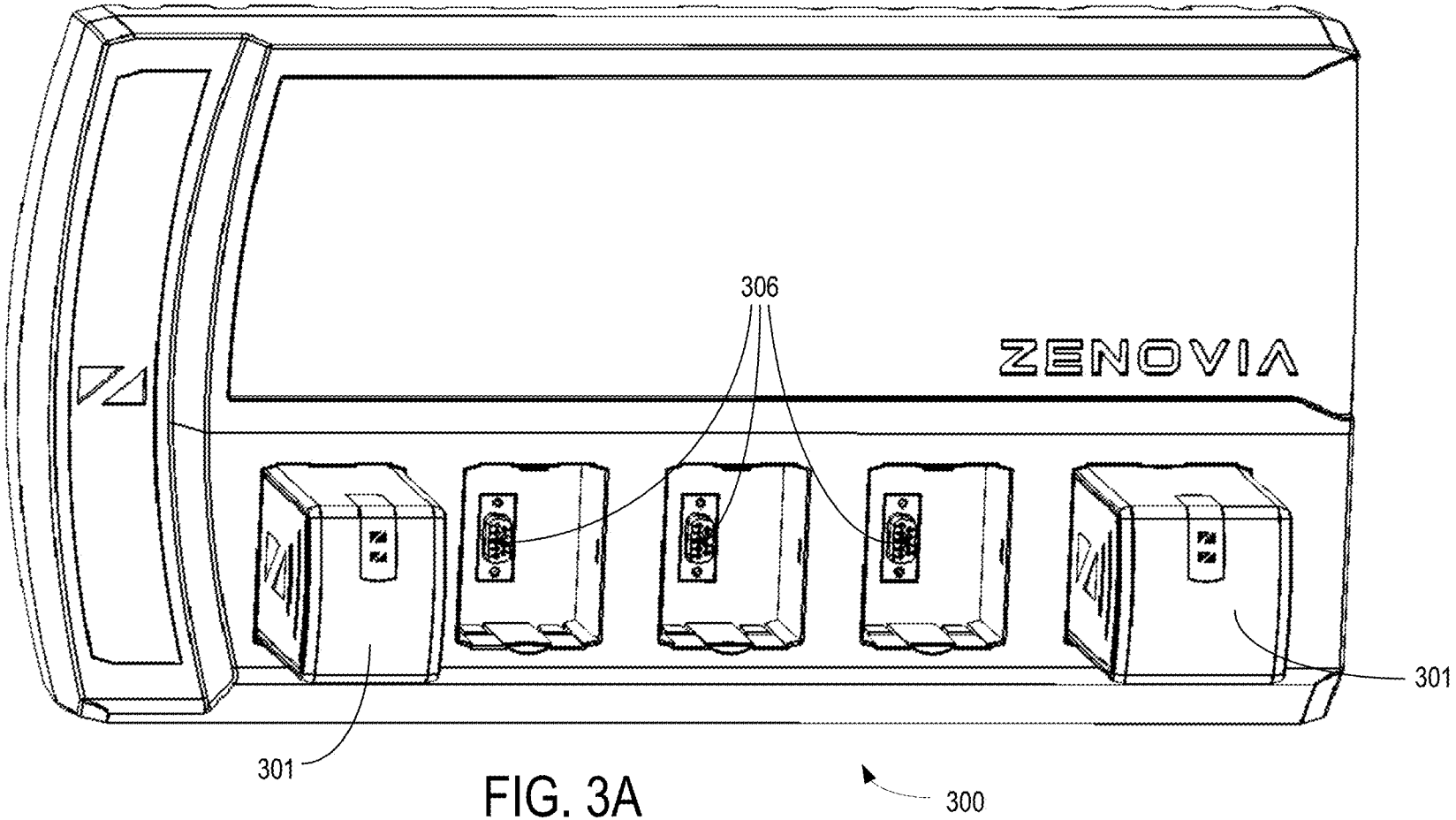
FIGS. 3A-3E show illustrative views of a panel housing for a modular audio processing, amplification and distribution system in accordance with another embodiment.
Figure 3B:
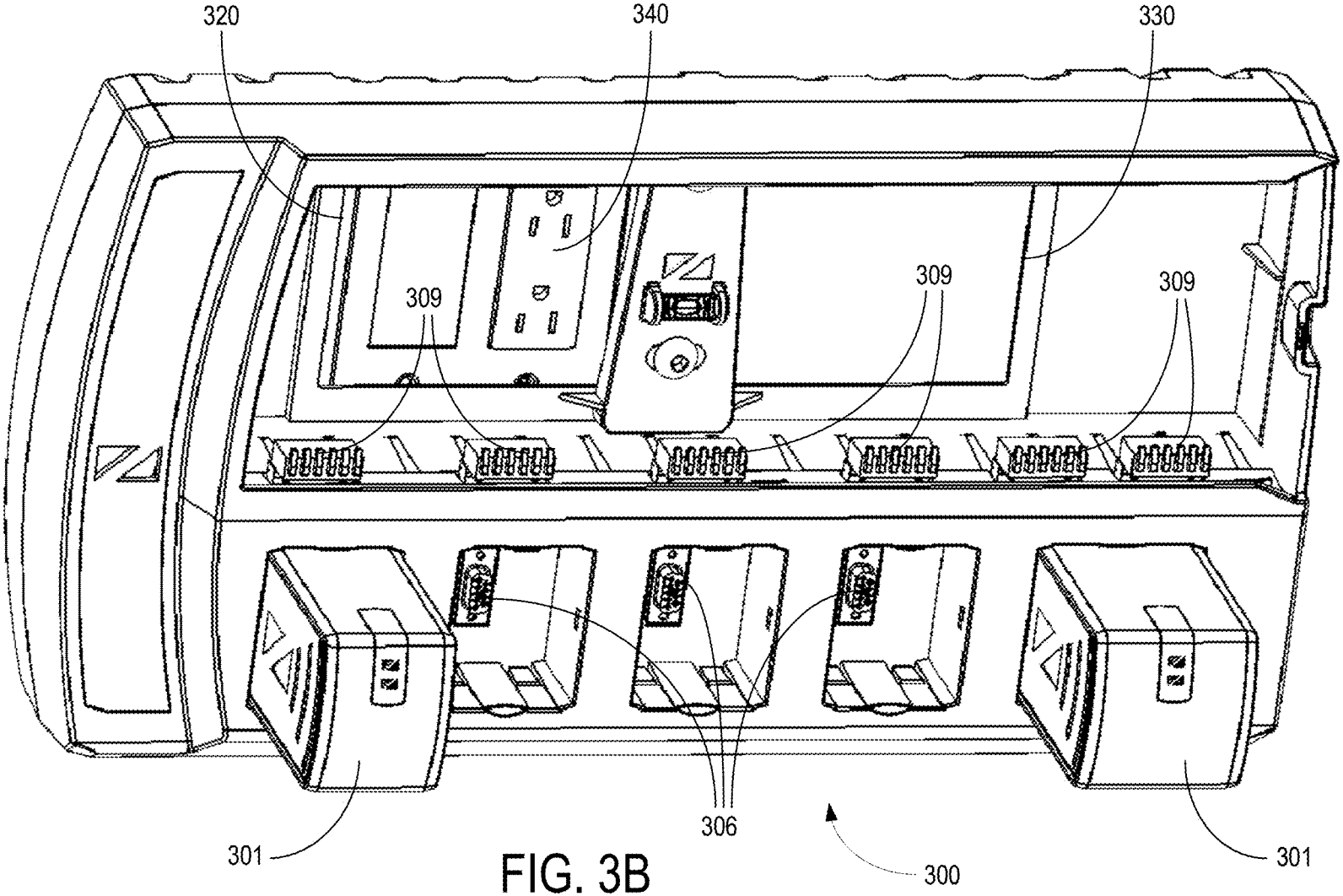

FIG. 3B shows another view of the processing, amplification and distribution system 300, in which a cover panel has been removed to show additional details. As shown, the processing, amplification and distribution system 300 may be configured to include access openings 320, 330 which allow the processing, amplification and distribution system 300 to be mounted adjacent an electrical outlet 340. The access openings 320, 330 further provide access to drill into a wall in order to allow connections of speaker cables running to the processing, amplification and distribution system 300 from different listening zones. Speaker cables (not shown) may then be connected to one of a plurality of speaker cable connection points 309.

Figure 3C:
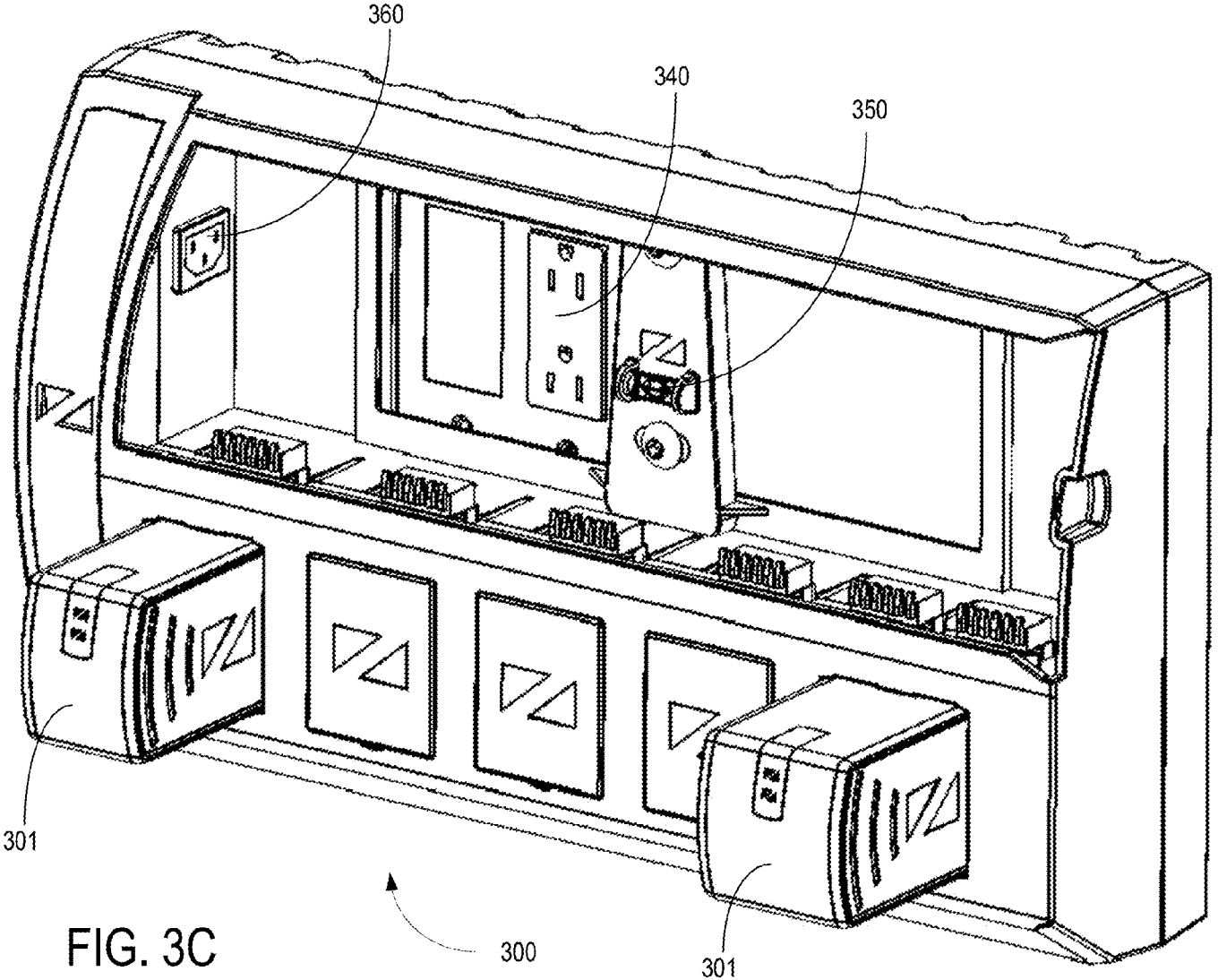

As shown in FIG. 3C in another view of the processing, amplification and distribution system 300, a level 350 may be used to squarely mount the processing, amplification and distribution system 300 against a wall using screws or other fastening means. A connector for a power outlet 360 allows a connection point for power to the processing, amplification and distribution system 300.

Figure 3D:
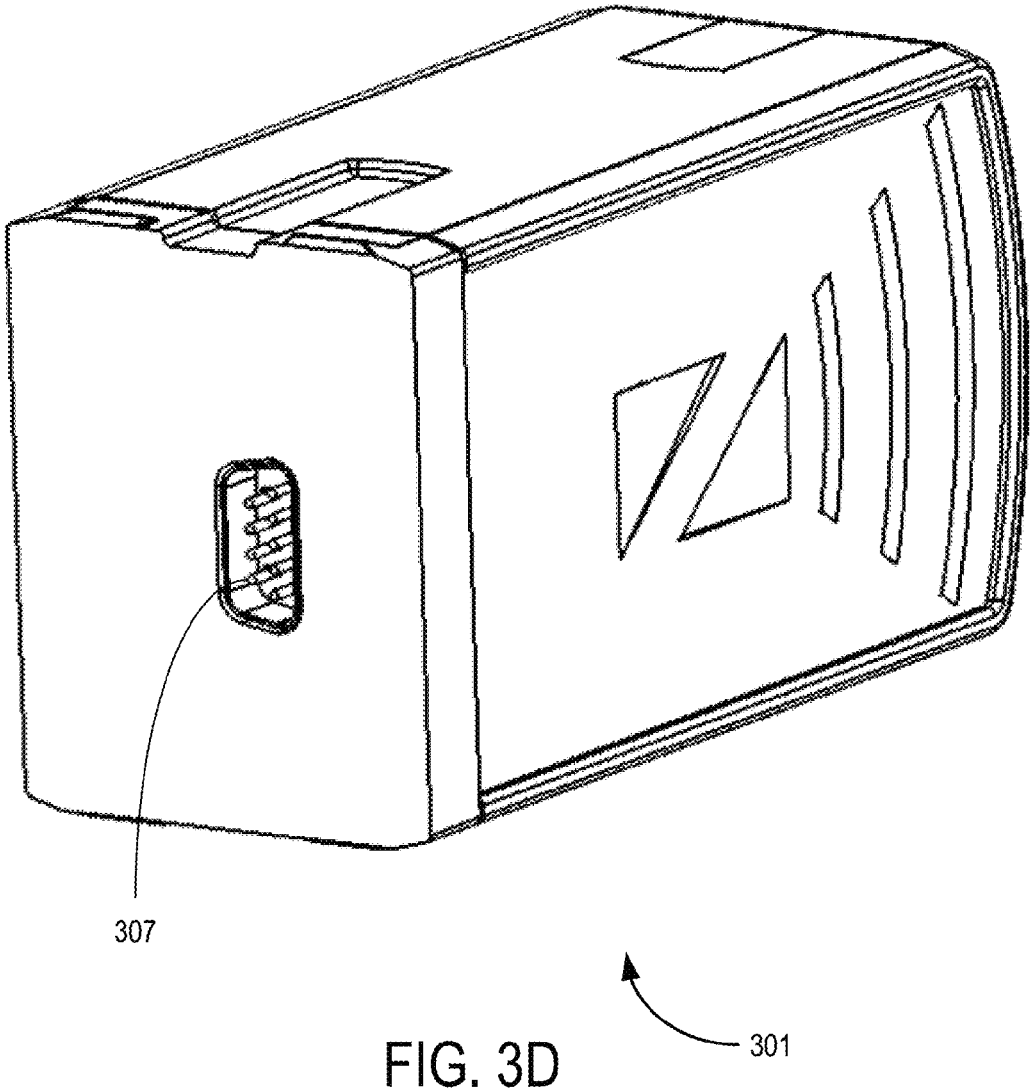

FIG. 3D shows an enlarged view of an illustrative modular processor/amplifier units 301, in which a pin connector 307 is suitably configured and used as a connection point to match with any one of connectors 306. By providing a common physical configuration for the modular processor/amplifier units 301, the modular processor/amplifier units 301 can be inserted into any slot to be connected to any one of the connectors 206 on the processing, amplification and distribution system 300.

In an embodiment, each modular processor/amplifier unit 301 includes a wireless transceiver, such that each modular processor/amplifier unit 301 is directly addressable from a wireless remote controller or wireless device.

In another embodiment, each modular processor/amplifier unit 301 includes an awake/sleep module (as described earlier), such that each modular processor/amplifier unit 301 is individually addressable to switch the modular processor/amplifier unit 301 between a sleep mode and an awake mode. In sleep mode, a minimal amount of power is provided to the awake/sleep module and other necessary modules to maintain sleep mode until a signal is received to switch the modular processor/amplifier unit 301 to an awake mode. In awake mode, full power is accessible by the modular processor/amplifier unit 301 to process and amplify any digital audio signal received from an audio source.

Figure 3E:
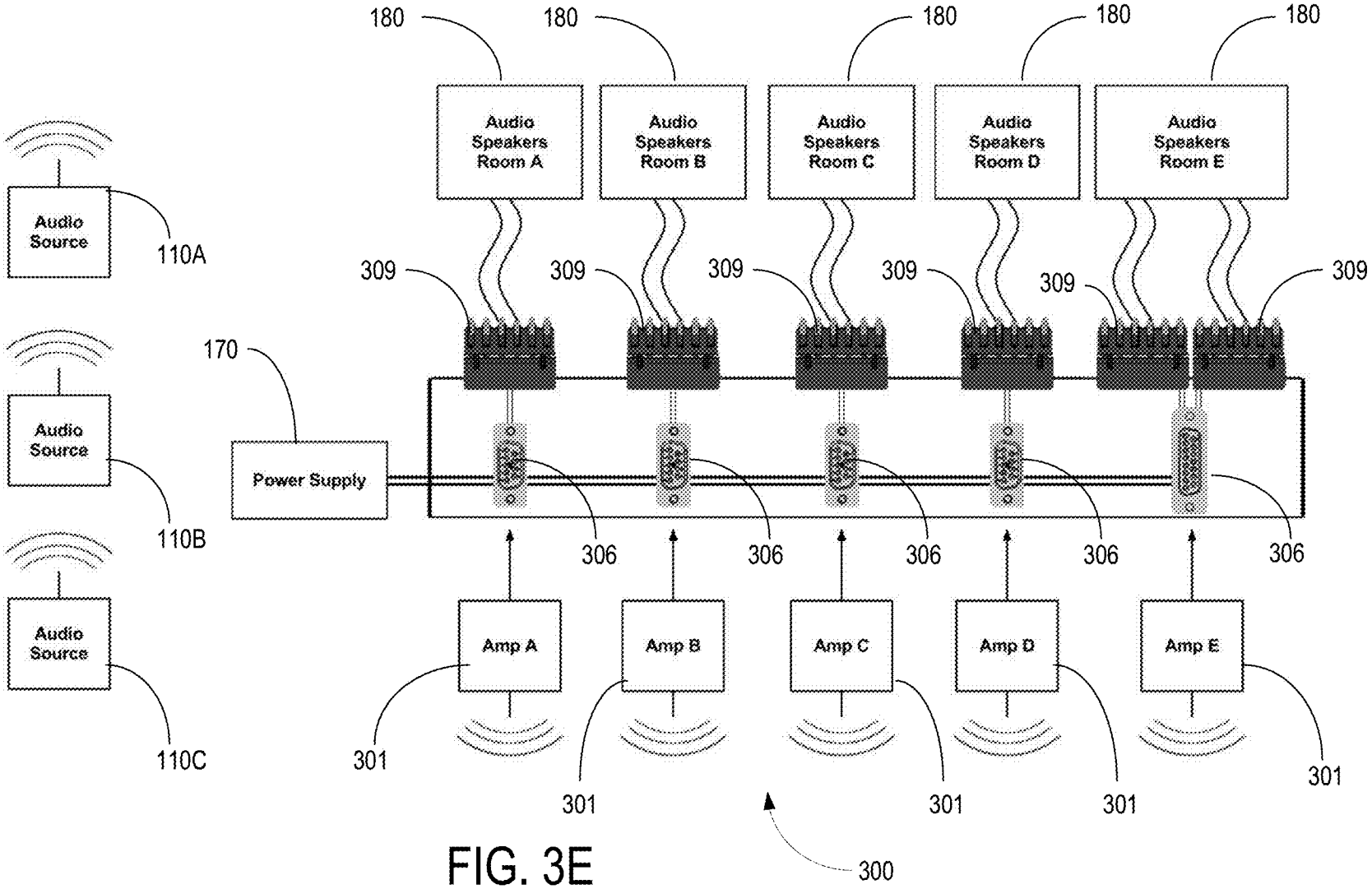

Now referring to FIG. 3E, shown is a schematic block diagram of another illustrative modular architecture for the panel housing for the modular audio processing, amplification and distribution system of FIGS. 3A-3D. As shown, in this illustrative embodiment, a plurality of modular processor/amplifier units 301 may be plugged into any one of the available connectors 306. A power supply 170 provides power to all modular processor/amplifier units 301 that are plugged into the processing, amplification and distribution system 300. The connectors 306 provide a signal path for connection to speaker wire connectors 309, which are in turn connected to audio speakers 180 located in different listening zones.

Still referring to FIG. 3E, a number of audio sources 110A-110C may broadcast wireless signals to different modular processor/amplifier units 301, each of which may be individually addressed to receive a wireless signal from the audio sources 110A-110C. One audio source can address many modular processor/amplifier units 301 simultaneously if it is desired to direct the audio signal to different listening zones simultaneously.

As illustrated above, speakers in different listening zones may be wired to the panel/housing. In an embodiment, without any modules, no amplification or audio playback is possible, and the speakers remain inactive. The audio zones are only activated or enabled with the insertion of an amplifier module. Thus, the modular audio processing and amplification units complete an audio circuit and allow the speakers to be engaged when the audio processing and amplification unit is awoken.

Figure 4A:
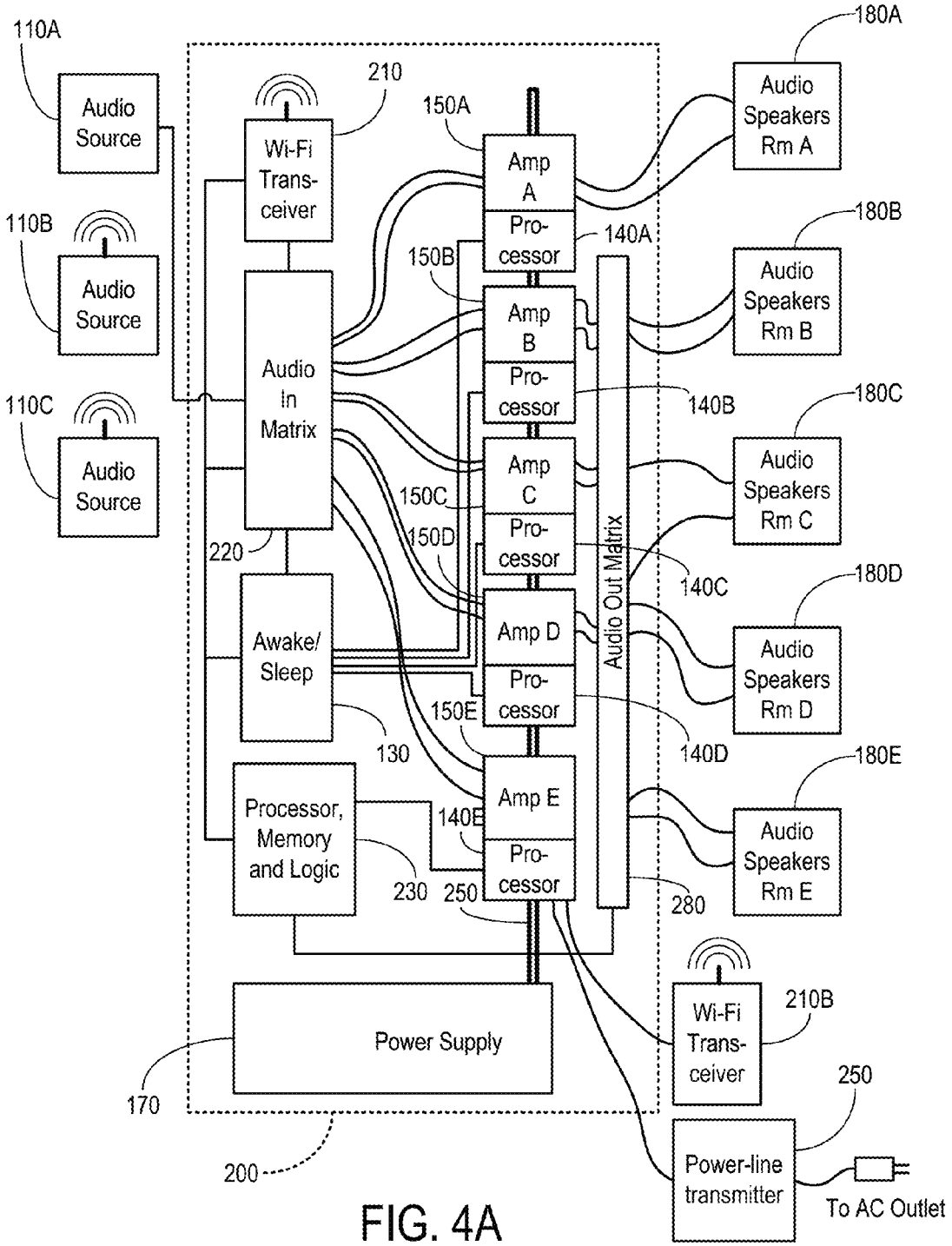
FIG. 4A shows a more detailed schematic block diagram of a modular audio processing, amplification and distribution system in accordance with an embodiment.

FIG. 4A shows a more detailed schematic block diagram of a modular audio amplification and distribution system 200 in accordance with an embodiment. As shown in FIG. 3, the system 200 receives a wired or wireless audio input signal from one or more audio sources 110A-110C. In this illustrative example, audio source 110A is wired directly to an audio in multi-switch 220 within the system 200. The other two audio sources, 110B and 110C, transmit a wireless audio signal which are received by a wireless transceiver, such as a Wi-Fi transceiver 210 as illustrated in FIG. 1. The Wi-Fi transceiver 210 is connected to audio in multi-switch 220 as well, such that all audio input signals pass through audio in multi-switch 220. While Wi-Fi is provided as an illustrative example of a wireless standard for transmitting digital audio signals, it will be appreciated that other wireless technologies may be used such as Bluetooth, and other wireless transmission standards.

In an embodiment, Wi-Fi transceiver 210 may be configured to be operatively connected to the Internet. Via this internet connection, Wi-Fi transceiver 210 may be adapted to locate and receive a plurality of Internet radio transmissions, and various other types of streamed or on-demand audio programming. In an embodiment, multiple audio inputs from the Internet may be processed simultaneously for distribution to different listening zones.

Audio in multi-switch 220 is operatively connected via conductive wires to a plurality of modular amplifier units 150A-150D. The modular amplifier units 150A-150D are configured to draw power from a power supply 170 via a power line to which each modular amplifier unit 150A-150D may be operatively connected.

Each modular amplifier unit 150A-150D has a processor module 140A-140D, which is operatively connected to awake/sleep module 130 described above. In this configuration, the signal sensing function performed by signal sensing module 120 of FIG. 1 may be integrated within awake/sleep module 130, or processor, memory and logic module 230. The processor, memory and logic module 230 is configured to control the processor modules 140A-140D via the awake/sleep module 130 as described in further detail below. In an embodiment, the processor modules 140A-140D may perform switch and gain functions to switch in and control the gain of the adjacent amplifier unit 150A-150D. Advantageously, by powering the modular amplifier units 150A-150D only as needed, the modular audio amplification and distribution system 200 can reduce the environmental impact of power drawn from unused amplifiers.

In an embodiment, a modular amplifier unit 150A may be connected directly to an audio speaker 180A in a specific audio listening zone (e.g. Room A). Alternatively, one or more modular amplifier units 150B-150D may be connected to an audio out matrix 280 to allow connection between modular amplifier units 150B-150D to one or more audio speakers 180B-180E located in various audio listening zones. As shown in FIG. 3, processor, memory and logic module 230 is operatively connected to audio out matrix 280 to be able to control which modular amplifier unit 150B-150D is connected to which audio speaker 180B-180E.

In an embodiment, the wired audio input signal from audio source 110A and/or the wireless audio input signals from audio sources 110B and 110C are digital audio sources containing addressing information in addition to the audio signal. For example, the addressing information may include the address of a specific amplifier device, a particular audio listening zone, or both, to which the audio signal should be directed. As an example, an audio input signal from audio source 110A may include address information directing that the audio input signal from audio source 110A be directed to modular amplifier unit 160A and to audio speakers 180A in Room A. As another example, an audio input signal from audio source 110B may include address information indicating that the audio input signal from audio source 110B should be directed to modular amplifier unit 150B, and to audio speakers 180B and 180C such that the audio input signal may be directed to both Room B and Room C. As yet another example, an audio input signal from audio source 110C may include address information directing the audio input to both modular amplifier units 150C and 150D. It is also possible that the address information can specify audio speakers in particular rooms, without specifying the particular modular amplifier units. In such a case, processor, memory and logic module 230 may be configured to assign the audio input signal to be amplified by a particular modular amplifier unit, or units as the case may be, depending on availability and the number of audio speakers to which amplified signals are to be sent.

Still referring to FIG. 4A, in an illustrative embodiment, a processor, memory and logic module 230 is operatively connected to the Wi-Fi transceiver 210, audio in multi-switch 220, and an awake/sleep module 130. Processor, memory and logic module 230 is configured to monitor the audio input signals received by audio in multi-switch 220 from a directly connected audio source 110A, or via Wi-Fi transceiver 210 from one or more wireless audio sources 110B, 110C. Processor, memory and logic module 230 is also configured to determine which audio input signals are directed to which a particular modular amplifier unit or units 150A-150D, as described above. If a particular modular amplifier unit or units 150A-150D are specified, processor, memory and logic module 230 can control the awake/sleep module to send a signal to the corresponding processor module 140A-140D to switch on the amplifier, and adjust the gain as necessary to control the volume of the sound emitted from the one or more audio speakers to which the amplified audio signal is output. In another embodiment, the processor modules 140A-140D may be controlled to keep the modular amplifier units 150A-150D on standby, to allow audio input signals directed to any one of the modular amplifier units 150A-150D to be amplified with minimal start-up time. This may be useful, for example, where a listener may be moving between various audio listening zones, and does not wish to hear any pause or gap in the audio when moving between rooms. Such an example is described in more detail further below.

In another embodiment, a modular amplifier unit 150E and processor module 140E may be configured to be detached from the audio output matrix 280, and instead be connected to a Wi-Fi transceiver 210B, or to a power-line transmitter 250. These alternative connection methods allow self-powered wireless speakers and power-line connected speakers to receive an audio signal wirelessly or through the power-line, respectively, to provide an alternative to connection via speaker cables.

Figure 4B:
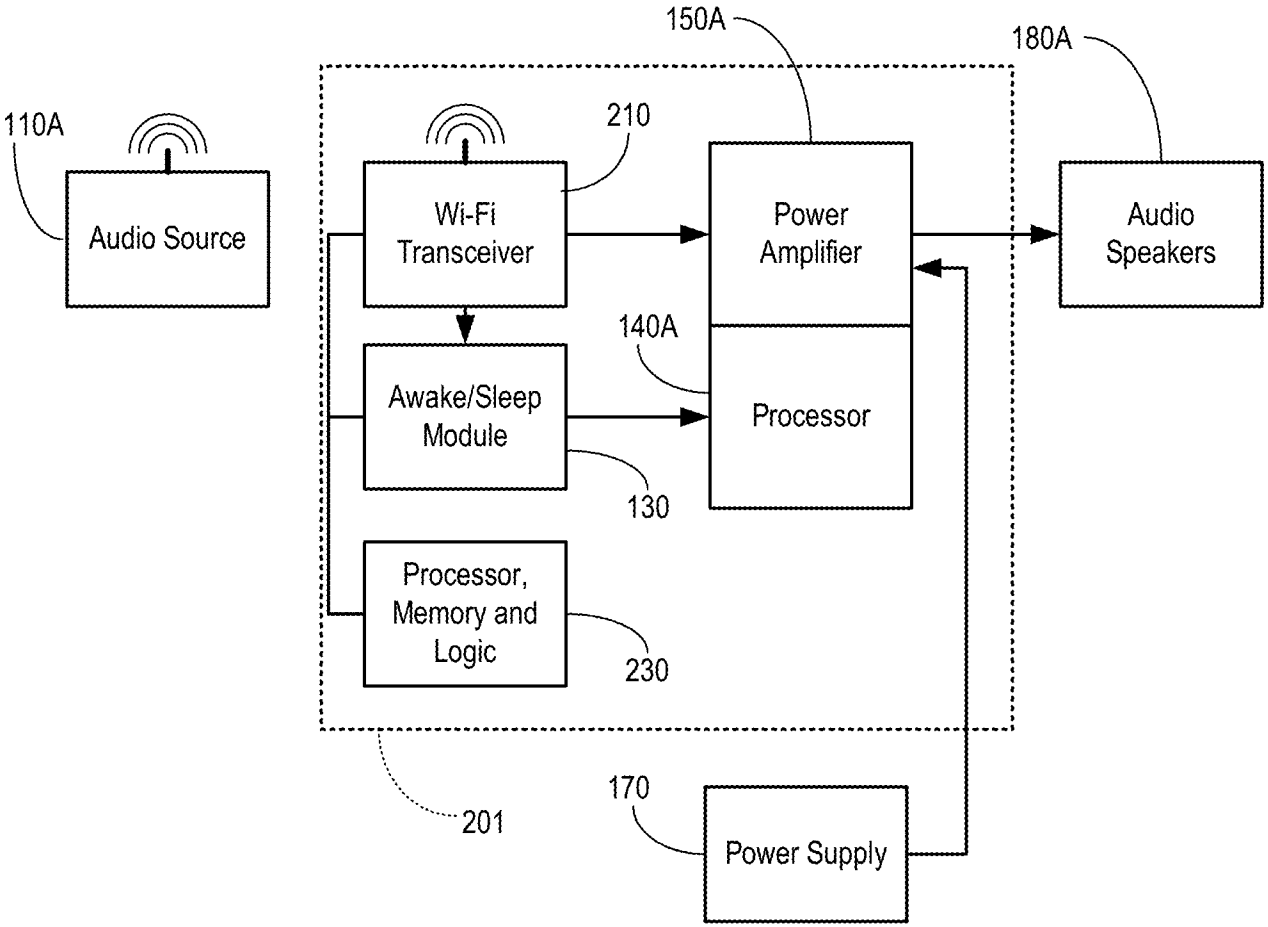
FIG. 4B shows a schematic block diagram of one possible distribution of an audio signal from an audio source to an audio speaker.

By way of illustration, FIG. 4B shows an alternative schematic block diagram in which some components shown in FIG. 4A are integrated within a single module 300 to receive audio signal from an audio source 110A and to amplify and output the signal to audio speakers 180A. In this illustrative example, integrated amplifier module 300 includes a Wi-Fi transceiver 210, awake/sleep module 130, processor, memory and logic 230, power amplifier 150A, and processor 140A. External to module 300 is power supply 170 and audio speakers 180A which may be connected within a panel housing as shown in FIGS. 2A-2C. Thus, different hardware configurations for the amplifier modules are possible, with each amplifier module 300 having integrated components for redundancy or specific design compatibility for the type of amplifier module on board.

Figure 4C:
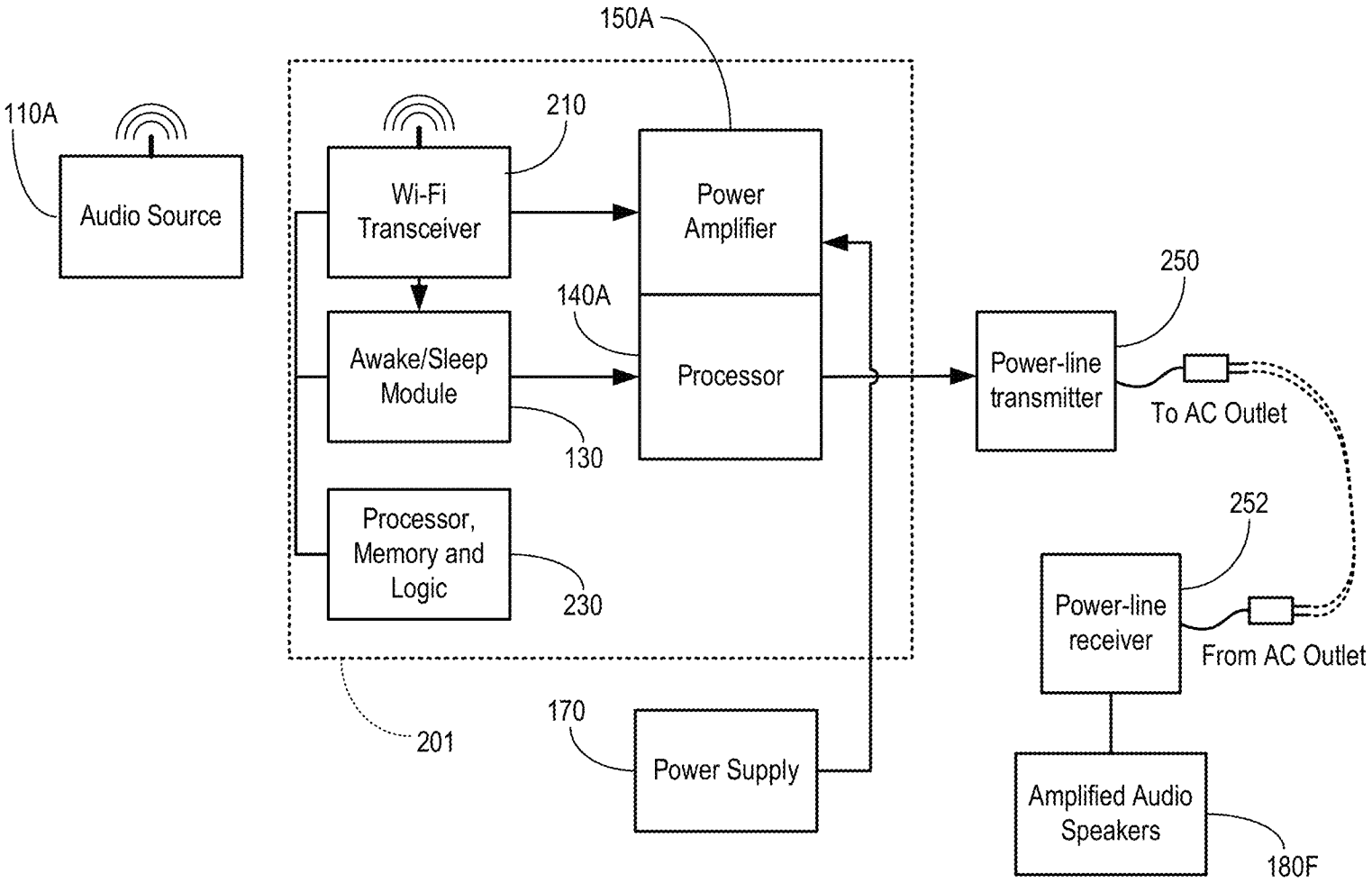
FIG. 4C shows a schematic block diagram of another possible distribution of an audio signal from an audio source to an audio speaker.

Now referring to FIG. 4C, shown is another possible distribution system and method for an audio signal from an audio source to an audio speaker. In this embodiment, rather than outputting an amplified signal from a power amplifier 150A, an audio signal may instead by output from processor 140A via a digital line output. This digital line output may be directed to a power-line transmitter 250 which is connected to an AC outlet within a house or building. The power-line transmitter is configured with appropriate signal modulators and filters to allow the output audio signal to be carried over the power-line to a power-line receiver 252 connected to another AC outlet within the house or building. The power-line receiver may receive and demodulate the audio signal to provide an analog audio signal for amplification by amplified audio speakers 180F. As will be appreciated, this method of connection avoids having to connect speakers in a distant room by a long length of speaker wire, and also allows for easier reconfiguration of the speakers and listening zones.

Figure 4D:
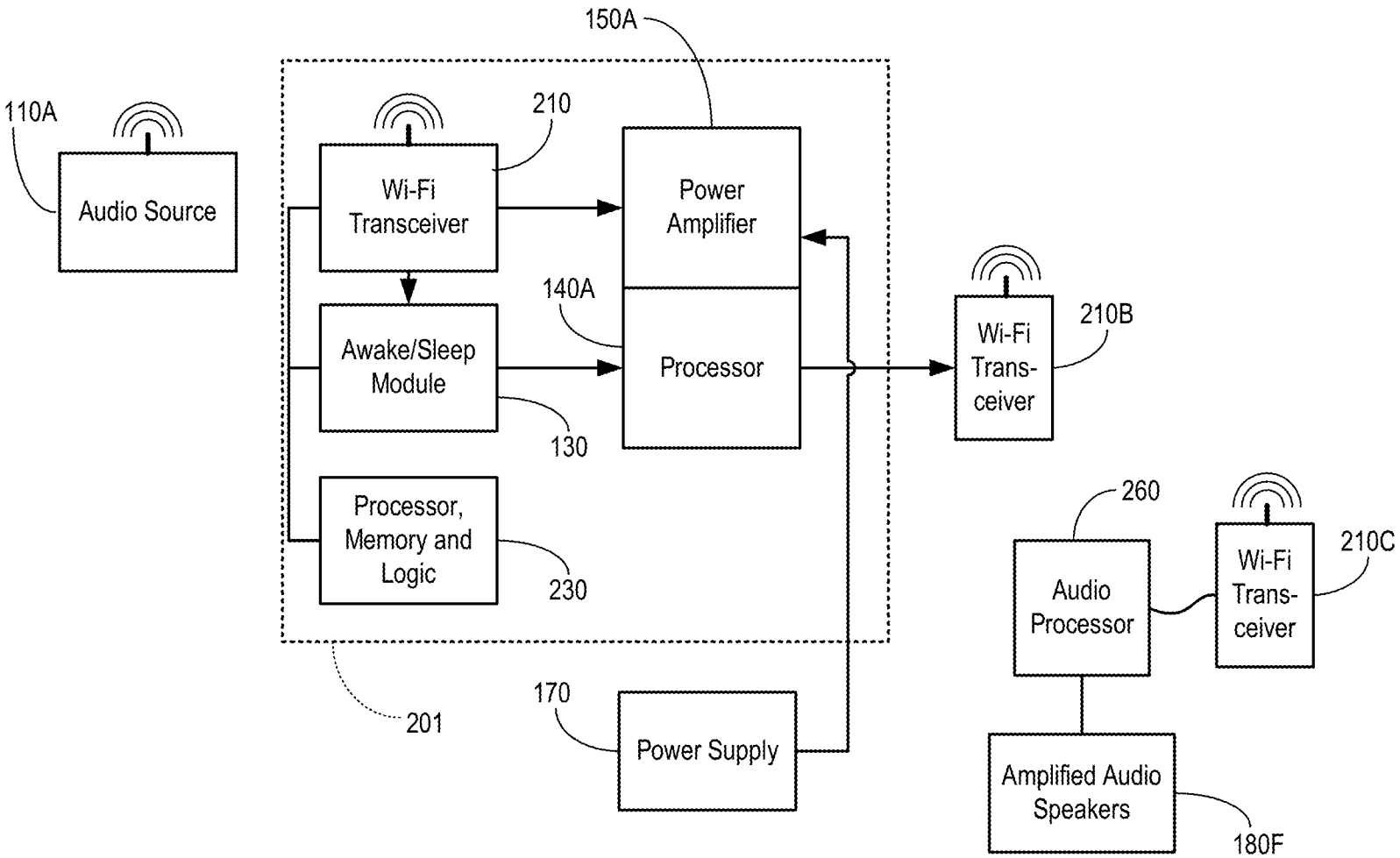
FIG. 4D shows a schematic block diagram of one possible distribution of an audio signal from an audio source to an audio speaker.

Now referring to FIG. 4D, shown is still another possible distribution system and method for an audio signal from an audio source to an audio speaker. In this embodiment, a digital line output is directed from processor 140A to a Wi-Fi transceiver 210B. In an embodiment, this Wi-Fi transceiver may be the Wi-Fi transceiver 210 previously shown in FIG. 4A. However, for the sake of clarity, a separate Wi-Fi transceiver 210B is shown. As illustrated, the digital audio output signal is transmitted via the Wi-Fi transceiver 210B to another Wi-Fi transceiver 210C located in one of the listening zones. Wi-Fi transceiver 210C is operatively connected to an audio processor 260 for demodulating the digital audio signal and converting the signal into an analog form for amplification by amplified audio speakers 180F. While it would be possible to direct an audio signal from a wireless audio source 110A directly to Wi-Fi transceiver 210C, it will be appreciated that passing the audio signal through the integrated amplifier module 300 avoids the necessity to individually control the wireless connection. Rather, centralized control over all audio input sources and audio outputs provides great flexibility over how audio inputs may be distributed to one or more speaker outputs.

As discussed previously, in an embodiment, the speakers may be connected by more than one connection means as described above. For example, in a listening zone, some of the speakers may be connected via a speaker wire connection while other speakers in the same listening zone may be connected by a power-line connection. A subwoofer which requires a separate AC power connection may be well suited for such a power-line connection even if other speakers in the listening zone are connected via speaker wire or by a wireless connection.

Figure 5:
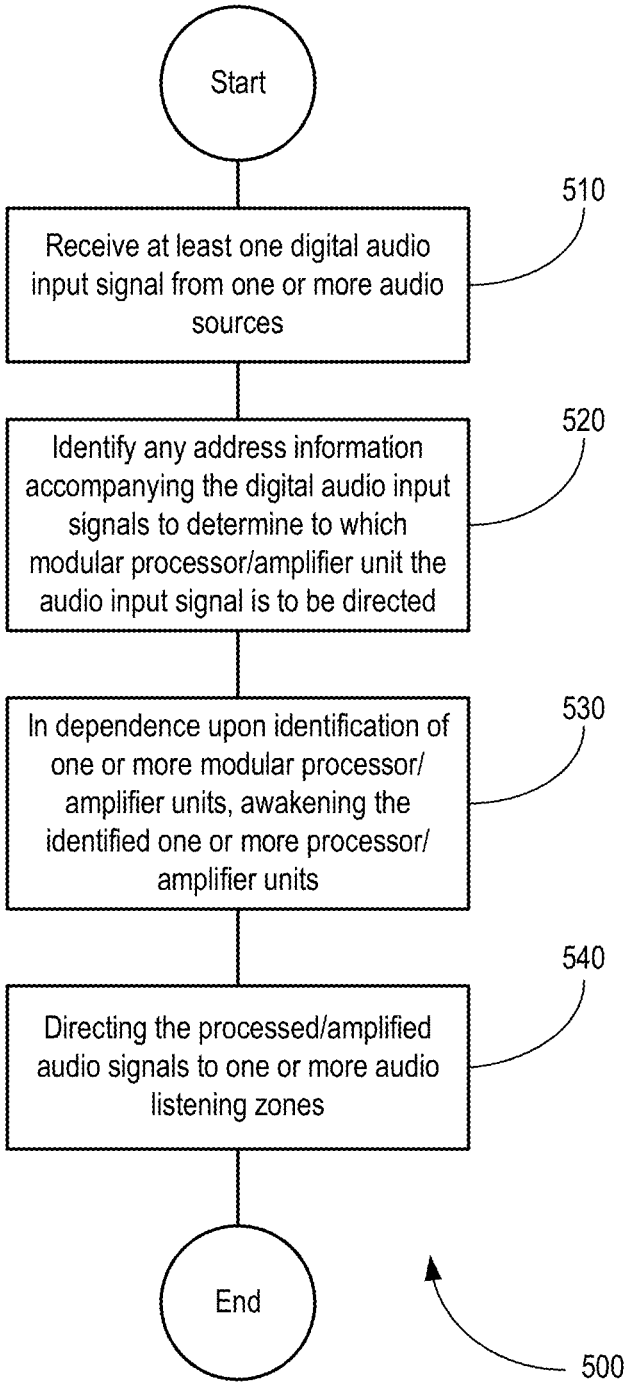
FIG. 5 shows an illustrative method in accordance with an embodiment.

Now referring to FIG. 5, shown is an illustrative method 500 in accordance with an embodiment. As shown, method 500 includes block 510 at which method 500 receives at least one digital audio input signal from one or more audio sources. Method 500 then proceeds to block 520, at which method 500 identifies any address information accompanying the at least one digital audio input signal to determine to which modular amplifier unit the audio signal is to be directed. Method 500 then proceeds to block 530, where, in dependence upon identification of one or more modular amplifier units, method 500 awakens the identified one or more amplifier units. Method 500 then proceeds to block 540, where method 500 directs the amplified audio signals to different audio listening zones.

With respect to the interchangeable modular nature of the amplifier units, it will be appreciated that the modular units need not be identical to each other, and may be designed to provide different audio configurations and performance characteristics. For example, modular amplifier units intended for surround sound distribution may require that a DTS surround sound decoder be inserted into the signal path within the module prior to the gain stage. The modular amplifier unit may be designed as an integrated module with all necessary chips, circuits and other IC components, and having a form factor allowing it to be installed within the modular audio amplification and distribution system 200 as described above. Surround sound amplifier units require multiple channels of amplification and may therefore be larger in size and require connectivity to more than one modular slot. For example, a stereo module may fit into a single slot, whereas a 5.1 surround module may require two slots, or a larger slot, in the modular audio amplification and distribution system 200. Mono, or other multi-channel audio formats may be supported as well, such as 5.1, 5.2, 7.1, 7.2, 9.1, 9.2, and so on.

Given the modular nature of the modular audio amplification and distribution system 200, it is envisaged by the inventor that the modular audio amplification and distribution system 200 could accommodate future developed audio standards to allow for continuous upgrading via interchangeable, modular amplifier units. This may be in response to newly developed audio sources which have not yet been developed, but which may become more widely adopted in the future. With the appropriate wireless transceiver module and necessary software, firmware and hardware modules to decode the signals installed, the modular audio amplification and distribution system 200 may receive any wired or wireless transmissions presently in existence and it is envisaged that the modular audio amplification and distribution system 200 may be upgraded to handle wired or wireless transmissions yet to be developed.

In an embodiment, the modular audio amplification and distribution system 200 need not include any advanced features or controls, if such controls can be provided by a front end controller. For example, the modular audio amplification and distribution system 200 may be controllable via a remote control or wireless device (such as a smart phone or touchpad) to control various functions. As an illustrative example, a control app installed and executed on a smart phone or touch pad may be used to control gain, settings, equalization, effects, compression, power setup (e.g. auto power-on signal sensing-off/on), and general system analysis.

In another embodiment, the location of a listener, or the presence of one or more listeners in one or more audio listening zones may be determined by a listener location detection means, such as a motion detector or any other suitable location detection device. Such a listener location detection means may be used by the processor, memory and logic module 230 to actively control which audio speakers 180A-180E are active at any given time.

In another embodiment, the location and identity of a listener may be determined by an object or device the listener is carrying, which may be identified by a near field identification technology such as radio frequency ID (RFID). By determining the location and identity of the listener, processor, memory and logic module 230 can actively modify the audio speakers to which an amplified signal is output such that the audio signal that the listener wishes to listen to can follow the listener automatically between audio listening zones.

While the above description provides examples of one or more methods and/or apparatuses, it will be appreciated that other methods and/or apparatuses may be within the scope of the present description as interpreted by one of skill in the art.

The invention claimed is:

1. A modular system for processing, amplification and distribution of audio signals, wherein the system is adapted to:

receive at a panel housing including one or more modular processor/amplifier units at least one digital audio input signal from one or more audio sources;

identify address information accompanying the at least one digital audio input signal to determine to which modular processor/amplifier unit in the panel housing the audio signal is to be directed;

awaken the identified one or more modular processor/amplifier units in dependence upon identification of one or more modular processor/amplifier units to process or amplify the at least one digital audio input signal; and direct the processed or amplified audio input signals to one or more audio listening zones via one or more speakers.

2. The system of claim 1, further comprising an audio out matrix adapted to allow connection between the one or more modular processor/amplifier units to one or more audio speakers located in the one or more audio listening zones.

3. The system of claim 2, wherein the system is further adapted to remotely switch the connection between the one or more modular processor/amplifier units to one or more audio speakers located in the one or more audio listening zones.

4. The system of claim 1, wherein the system is further adapted to remotely control the volume of the speakers in a listening zone by adjusting a gain in the one or more modular processor/amplifier units.

5. The system of claim 1, wherein the system is further adapted to remotely control the awakening of one or more modular processor/amplifier units required for processing and amplifying a digital audio signal from the one or more audio sources.

6. The system of claim 1, wherein the system is further adapted to detect the presence of a listener in the one or more audio listening zones, and to actively control the direction of the processed or amplified audio input signals to the one or more audio listening zones via one or more speakers.

7. The system of claim 1, wherein the system is further adapted to detect the location and identity of a listener in one or more audio listening zones, and to actively control the direction of the processed or amplified audio input signals to the one or more audio listening zones via one or more speakers.

8. The system of claim 7, wherein the location and identity of a listener may be determined by an object or device the listener is carrying.

9. The system of claim 8, wherein the system is further adapted to modify the direction of the processed or amplified audio input signals to the one or more audio listening zones via one or more speakers to automatically follow the listener between the one or more audio listening zones.

10. The system of claim 1, wherein the system is further adapted to be remotely controllable via a wireless device controllable by a listener to actively control the direction of the processed or amplified audio input signals to the one or more audio listening zones via one or more speakers.

11. A method of processing, amplification and distribution of audio signals, comprising:

receiving at a panel housing including one or more modular processor/amplifier units at least one digital audio input signal from one or more audio sources;

identifying address information accompanying the at least one digital audio input signal to determine to which modular processor/amplifier unit in the panel housing the audio signal is to be directed;

in dependence upon identification of one or more modular processor/amplifier units, awakening the identified one or more modular processor/amplifier units to process or amplify the at least one digital audio input signal; and directing the processed or amplified audio input signals to one or more audio listening zones via one or more speakers.

12. The method of claim 11, further comprising connecting the one or more modular processor/amplifier units to one or more audio speakers located in the one or more audio listening zones via an audio out matrix.

13. The method of claim 12, further comprising remotely switch the connection between the one or more modular processor/amplifier units to one or more audio speakers located in the one or more audio listening zones.

14. The method of claim 11, further comprising remotely controlling the volume of the speakers in a listening zone by adjusting a gain in the one or more modular processor/amplifier units.

15. The method of claim 11, further comprising remotely controlling the awakening of one or more modular processor/amplifier units required for processing and amplifying a digital audio signal from the one or more audio sources.

16. The method of claim 11, further comprising detecting the presence of a listener in the one or more audio listening zones, and actively controlling the direction of the processed or amplified audio input signals to the one or more audio listening zones via one or more speakers.

17. The method of claim 11, further comprising detecting the location and identity of a listener in one or more audio listening zones, and actively controlling the direction of the processed or amplified audio input signals to the one or more audio listening zones via one or more speakers.

18. The method of claim 17, further comprising determining the location and identity of a listener by an object or device the listener is carrying.

19. The method of claim 18, further comprising modifying the direction of the processed or amplified audio input signals to the one or more audio listening zones via one or more speakers to automatically follow the listener between the one or more audio listening zones.

20. The method of claim 11, further comprising allowing wireless remote control of the direction of the processed or amplified audio input signals to the one or more audio listening zones via one or more speakers.

* * * * *